US010758932B2

(12) United States Patent
Schnur et al.

(10) Patent No.: US 10,758,932 B2
(45) Date of Patent: Sep. 1, 2020

(54) APPLICATOR FOR APPLYING A THICK MATTER, REPLACEMENT PART THEREFOR AND CORRESPONDING OPERATING METHOD

(71) Applicant: Dürr Systems AG, Bietigheim-Bissingen (DE)

(72) Inventors: Frank Schnur, Bönnigheim (DE); Martin Wolf, Kirchberg an der Murr (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 0 days.

(21) Appl. No.: 16/316,949

(22) PCT Filed: Jul. 3, 2017

(86) PCT No.: PCT/EP2017/066518
§ 371 (c)(1),
(2) Date: Jan. 10, 2019

(87) PCT Pub. No.: WO2018/010997
PCT Pub. Date: Jan. 18, 2018

(65) Prior Publication Data

US 2019/0160484 A1 May 30, 2019

(30) Foreign Application Priority Data

Jul. 15, 2016 (DE) ..... 10 2016 008 643

(51) Int. Cl.
*B05C 5/02* (2006.01)
*B05C 17/005* (2006.01)

(52) U.S. Cl.
CPC ..... *B05C 5/0216* (2013.01); *B05C 5/0229* (2013.01); *B05C 5/0233* (2013.01); *B05C 17/00516* (2013.01); *B05C 5/0225* (2013.01)

(58) Field of Classification Search
USPC ..... 118/300; 239/544, 566–568, 601
See application file for complete search history.

(56) References Cited

U.S. PATENT DOCUMENTS 6,261,367 B1 * 7/2001 Donges ..... B05C 5/0225 118/300
7,708,211 B2 * 5/2010 Maier ..... B05C 17/00516 239/456

(Continued)

FOREIGN PATENT DOCUMENTS

DE 19938328 A1 2/2001
DE 102007056121 B3 9/2008

(Continued)

OTHER PUBLICATIONS

International Search Report and Written Opinion for PCT/EP2017/066518 dated Sep. 28, 2017 (11 pages; with English translation).

*Primary Examiner* — Yewebdar T Tadesse
(74) *Attorney, Agent, or Firm* — Bejin Bieneman PLC

(57) ABSTRACT

The disclosure concerns an applicator for applying a coating agent (e.g. thick matter) to a component (e.g. motor vehicle body part) with a nozzle with a nozzle opening with a certain nozzle geometry, in particular for applying a thick matter bead to a component surface. The disclosure provides that the nozzle geometry of the nozzle opening can be adjusted without replacing the nozzle, in particular by a relative movement of two nozzle parts. Furthermore, the disclosure comprises an exchange part for such an applicator and an operating method therefor.

17 Claims, 3 Drawing Sheets

(56) References Cited

U.S. PATENT DOCUMENTS

| | | | | |
|---|---|---|---|---|
| 9,545,638 | B2 * | 1/2017 | Spiryagin | B05C 5/02 |
| 2007/0210187 | A1 | 9/2007 | Maier et al. | |

FOREIGN PATENT DOCUMENTS

| | | | |
|---|---|---|---|
| DE | 102012014974 | A1 | 1/2014 |
| WO | 2013030828 | A2 | 3/2013 |

* cited by examiner

APPLICATOR FOR APPLYING A THICK MATTER, REPLACEMENT PART THEREFOR AND CORRESPONDING OPERATING METHOD

CROSS-REFERENCE TO RELATED APPLICATIONS

This application is a national stage of, and claims priority to, Patent Cooperation Treaty Application No. PCT/EP2017/066518, filed on Jul. 15, 2016, which application claims priority to German Application No. DE 10 2016 008 643.2, filed on Jul. 15, 2016, which applications are hereby incorporated herein by reference in their entireties.

BACKGROUND

The disclosure concerns an applicator for applying a coating agent (e.g. thick matter, in particular adhesive or sealant) to a component (e.g. motor vehicle body component), in particular for applying a thick matter bead to a component surface. Furthermore, the disclosure concerns a replacement part for such an applicator and a corresponding method of operation for it.

It is known from the state of the art to apply a so-called adhesive bead to a component surface with an applicator. An application robot guides the applicator along a specified path over the component surface. During this movement, the applicator releases the adhesive from a nozzle onto the component surface, so that the adhesive forms the adhesive bead on the component surface. The known nozzles for such an applicator usually consist of a tube which narrows in the direction of flow and has a V-shaped nozzle slot at its end in the wall of the tube. The nozzle is guided over the surface of the component when the adhesive bead is applied, whereby the nozzle is aligned at an angle to the surface of the component. A similar applicator is also known from DE 199 38 328 A1.

A disadvantage of these known applicators is the fact that the nozzle geometry is fixed and can only be changed by replacing the respective nozzle. However, a nozzle change requires a certain period of time, which is problematic in a thick matter system for serial coating (e.g. adhesive coating) of motor vehicle body components due to the required time expenditure, since the nozzle change can limit the achievable cycle time during painting.

DETAILED DESCRIPTION

Figure 1A:
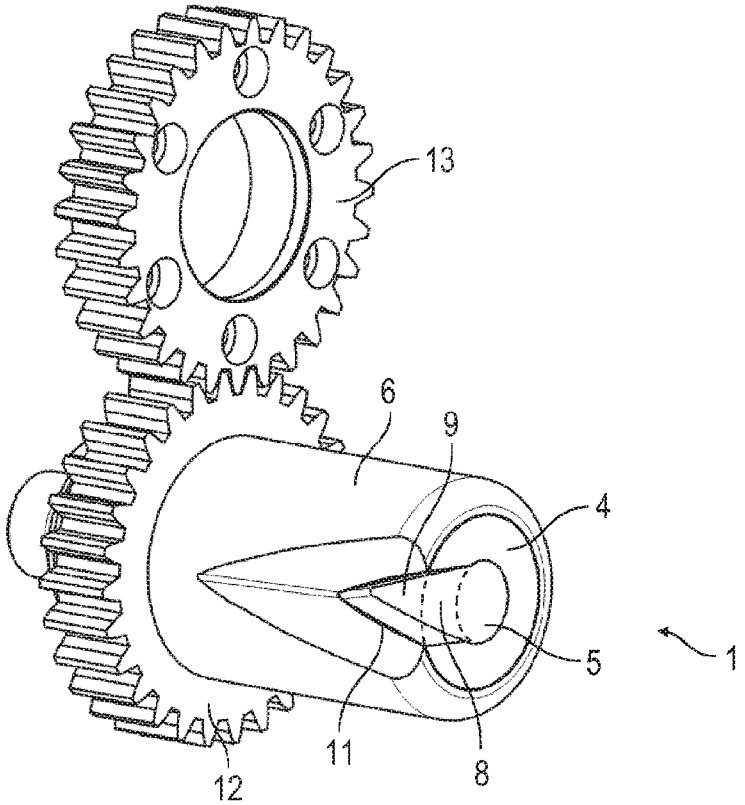
FIG. 1A a schematic perspective view of an inventive applicator in a setting with a maximum nozzle opening size, FIG. 1B a side view of the applicator from FIG. 1A, FIG. 2A a schematic perspective view of the applicator from FIGS. 1A and 1B in a setting with a reduced nozzle opening size, FIG. 2B a side view of the applicator from FIG. 2A.

The disclosure comprises the general technical teaching of creating an applicator in which the nozzle geometry of the nozzle opening can be adjusted without replacing the nozzle, in particular by a relative movement of two nozzle parts, which will be described in detail.

In an illustrative embodiment of the disclosure, the applicator is adapted to apply a thick matter, such as an adhesive, a sealant or an insulating material. For example, the term thick matter also includes sprayable, often PVC-containing materials (PVC: polyvinyl chloride), which are used, for example, for welding seam sealing, cavity preservation or underbody protection of car bodies. However, with regard to the coating agent to be applied, the disclosure is not limited to such thick substances, but can in principle also be realized with other types of coating agents.

It should also be mentioned that the applicator may be adapted to apply the coating agent (e.g. thick matter) to a motor vehicle body component. However, with regard to the type of component, the disclosure is not limited to motor vehicle body components, but can basically also be realized with other types of components.

It has already been mentioned above that the disclosure offers the possibility of adjusting the nozzle geometry of the nozzle opening without replacing the nozzle. For example, the size of the nozzle opening can be adjusted, in particular the height of the nozzle opening in axial direction, in order to influence the height of the thick matter bead on the component surface. For example, in a V-shaped nozzle opening, the height of the resulting triangular bead on the component surface is determined by the axial length of the V-shaped nozzle opening. As an alternative, however, it is also possible within the scope of the disclosure that the shape of the nozzle opening can be adjusted in order to adapt the resulting shape of the thick matter bead on the component surface accordingly. These two possibilities (adjustment of the size and shape of the nozzle opening) can also be combined within the scope of the disclosure. However, the disclosure also offers the possibility that only the size of the nozzle opening is changed, while the shape (e.g. triangular shape or V-shape) remains unchanged.

In one example, the nozzle has an inner tube, whereby the inner tube is preferably fixedly attached to the applicator and during operation the coating agent to be applied (e.g. thick matter) flows through it. In addition, the nozzle preferably has an outer tube which surrounds the inner tube on the outside and runs coaxially to the inner tube. The outer tube can be rotated about its longitudinal axis relative to the inner tube in order to adjust the nozzle geometry. The nozzle geometry of the nozzle opening thus depends on the relative angle of rotation of the outer tube and inner tube.

For this purpose, the inner tube and the outer tube each have a nozzle contour in their lateral surfaces, which together form the nozzle opening. Depending on the angular orientation of the outer tube relative to the inner tube, these two nozzle contours in the inner tube and in the outer tube then lie more or less on top of each other conforming to each other, with the area of the two nozzle contours lying on top of each other conforming to each other forming the free nozzle opening. A rotation of the outer tube relative to the inner tube thus leads to a change in the overlapping areas of the two nozzle contours, whereby the cross-section of the free nozzle opening is changed.

The nozzle contours in the inner tube or outer tube may be substantially V-shaped and start from the peripheral edge of the inner tube or outer tube at its free end, the nozzle contours then narrowing in the proximal direction. This means that a rotation of the two V-shaped nozzle contours relative to each other leads to a corresponding change in the likewise V-shaped nozzle cross-section. It should be mentioned here that the shape of the nozzle opening remains independent of the angle of rotation of the inner tube and outer tube and is always V-shaped. In this embodiment, a twisting of the inner and outer tubes only leads to a change in the size of the nozzle opening, not to a change in the shape of the nozzle opening.

In addition to the example with an outer tube and an inner tube, it should be mentioned that the inner diameter of the outer tube is essentially the same as the outer diameter of the inner tube. The wall of the outer tube at the peripheral edge of the second nozzle contour in the outer tube is preferably knife-shaped and rests with a cutting edge on the outer wall of the inner tube. This ensures a sharp tear-off edge at the transition from the inner tube to the outer tube.

It should also be mentioned that the applicator according to the disclosure may have a drive for adjusting the nozzle geometry, whereby the drive moves the two nozzle parts that are adjustable relative to each other (e.g. outer tube and inner tube) relative to each other. The drive may have a motor (e.g. electric motor) to make the adjustment. However, the drive can also work pneumatically or be designed as a direct drive. For example, the drive can have a gear drive. In this case, a first gear wheel is arranged rotatably and coaxially to the outer tube and torsionally rigidly connected to the outer tube. Turning of that first gear wheel thus will result in a corresponding rotation of outer tube relative to inner tube. In addition, the gear drive may have a rotatable second gear that engages the first gear to rotate the outer tube relative to the inner tube. The first gear wheel on the outer tube can be integrally moulded to the outer tube, which enables cost-effective production of the outer tube with the gear wheel. For example, the first gear wheel can form an injection-moulded part together with the outer tube.

Furthermore, it should be mentioned that the nozzle may be configured in such a way that it forms a thick matter bead (e.g. adhesive bead) on the component surface during operation, which in itself is known from the state of the art and therefore does not need to be described in more detail.

It should also be mentioned that the applicator may have a connection flange for detachable mounting of the applicator, for example on an application robot. This connection flange can be operated without tools so that the applicator can be detached from the application robot without tools. For example, a bayonet coupling can be used for this purpose.

Furthermore, the outer tube can also be removed from or mounted to the inner tube without tools, for which a bayonet lock can also be used. This makes it possible to manufacture the outer tube with the gear wheel formed on it, if necessary, as a replacement part that does not have to be cleaned, but is simply replaced.

The disclosure also is directed to a complete application robot with such an applicator.

It should be mentioned, however, that it is possible within the disclosure to adjust the nozzle geometry of the nozzle during the movement of the nozzle. This makes it possible to adjust the geometry of the thick matter bead on the component surface along the thick matter bead.

The drawings show different views of an applicator 1 for applying a thick matter bead of a thick matter (e.g. adhesive, sealant) to a component surface 2 of a component 3 (e.g. motor vehicle body component).

In principle, it is known from the state of the art to apply thick matter beads to component surfaces, so that a detailed description of the application of thick matter beads can be dispensed with, as reference is made to the state of the art in this respect.

Furthermore, it should be mentioned that the drawings only schematically represent the principle of the disclosure, so that variations in size and design of the individual components are possible.

The applicator 1 initially has a hollow cylindrical inner tube 4, through which the coating agent to be applied flows during operation and which has a frontal orifice 5 at its free end.

In addition, applicator 1 has an outer tube 6, which surrounds the inner tube 4 on the outside and runs coaxially to the inner tube 4. The inner diameter of the outer tube 6 is equal to the outer diameter of the inner tube 4.

It should also be mentioned that the inner tube 4 is fixed to applicator 1, while the outer tube 6 is rotatable relative to the inner tube 4 about its longitudinal axis 7.

The free end of the inner tube 4 has a V-shaped nozzle contour 8 in its lateral surface, which narrows in a V-shape starting from the free end in the proximal direction.

The outer tube 6 has a V-shaped nozzle contour 9 at its free end in its circumferential surface, which starts from the free end of the outer tube 6 and narrows in a V-shaped manner in the proximal direction.

The two V-shaped nozzle contours 8, 9 in the inner tube 4 and in the outer tube 6 can be brought more or less into alignment by rotating the outer tube 6 relative to the inner tube 4 and thus form a nozzle opening 10 with an adjustable size.

Figure 1B:
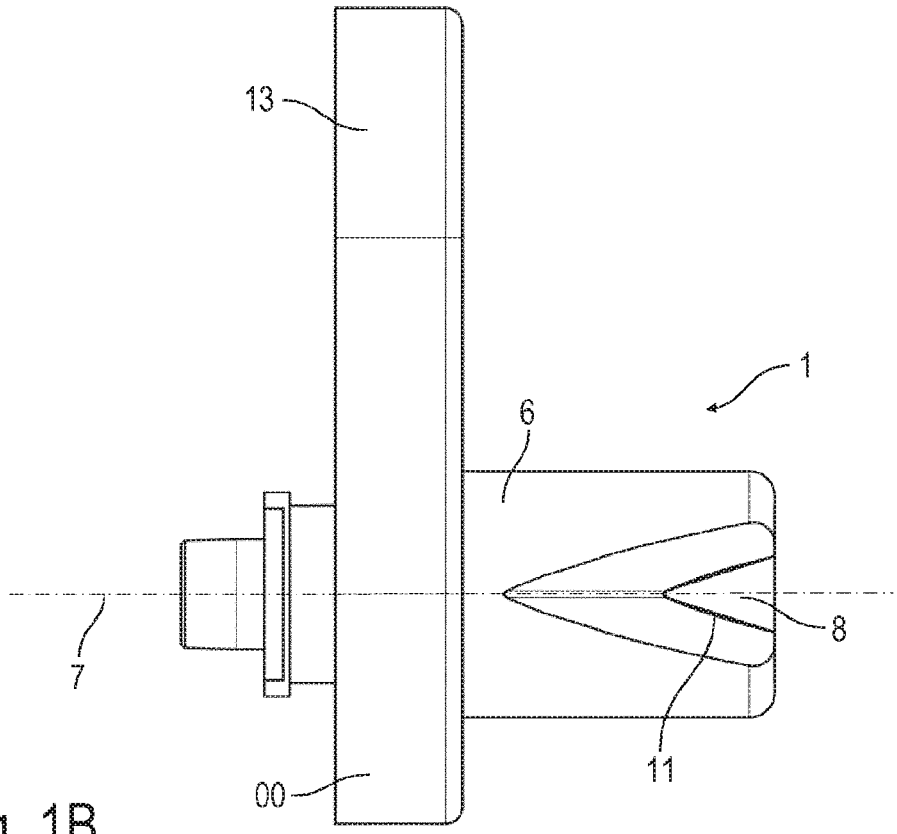

In the position according to FIGS. 1A and 1B, the two nozzle contours 8, 9 of the outer tube 6 and the inner tube 4 lie exactly one above the other in alignment. This leads to a maximum size of the resulting nozzle opening 10.

Figure 2A:
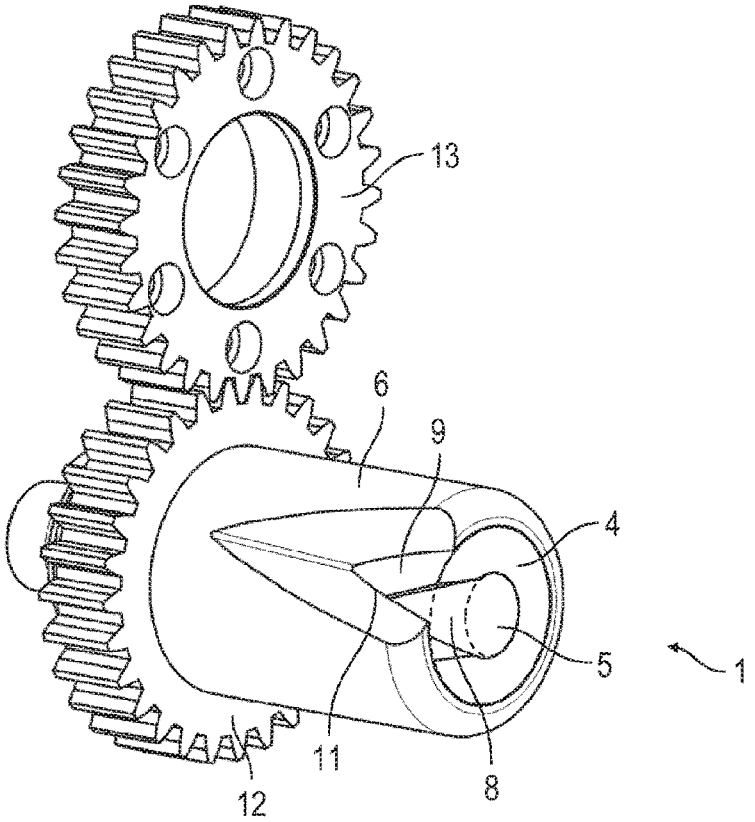
Figure 2B:
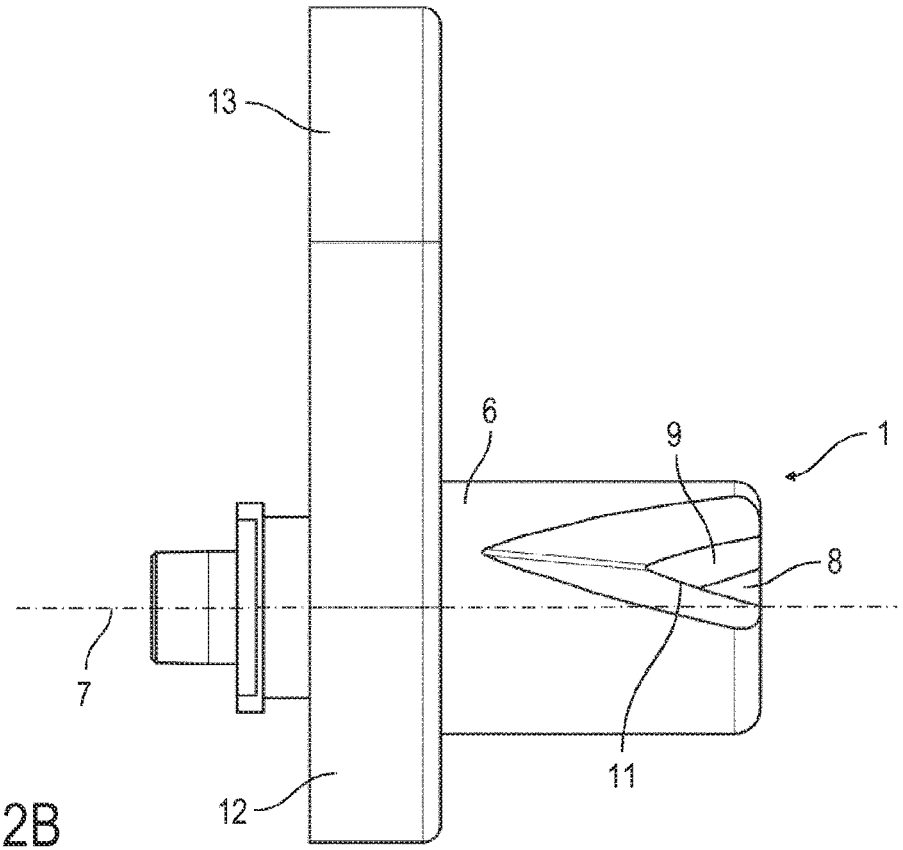
Figure 4A:
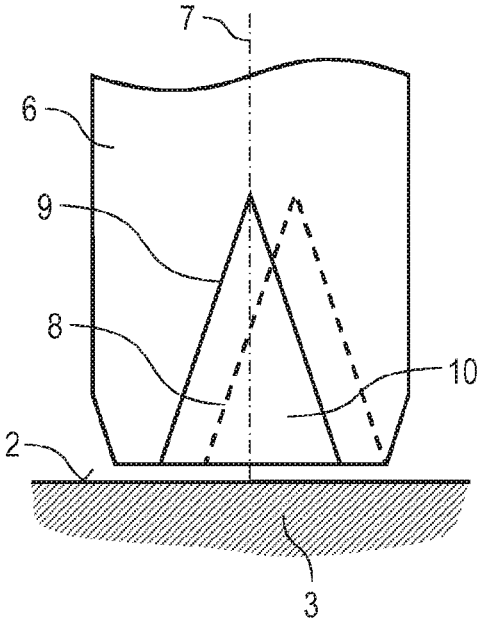
FIG. 4A is a setting other than FIG. 3A with a reduced nozzle opening size.

In the angular position according to FIGS. 2A and 2B, the two nozzle contours 8, 9 of the outer tube 6 and the inner tube 4 are twisted relative to each other, which results in the nozzle opening 10 being correspondingly smaller.

It should also be mentioned that the outer tube 6 forms a cutting edge 11 at the edge of the V-shaped nozzle contour 9, which rests on the outer wall of the inner tube 4 and forms a sharp tear-off edge for the coating material (e.g. adhesive).

The size of the nozzle opening 10 of applicator 1 can therefore be adjusted continuously and very precisely and finely by rotating the outer tube 6 relative to the inner tube 4. This rotation is driven by a toothed gear, whereby the toothed gear is again driven by an electric motor (not shown). The gear drive initially has a gear wheel 12, which is torsionally rigidly connected to the outer tube 6. In addition, the gear unit has another gear wheel 13, which engages in the gear wheel 12 and is driven by the electric motor. A rotation of the electric motor via the two gears wheels 12, 13 leads to a corresponding rotation of the outer tube 6 relative to the inner tube 4 and thus to a corresponding change in the size of the nozzle opening 10.

It should be mentioned here that the gear wheel 12 is integrally moulded to the outer tube 6, which makes a cost-effective production possible. It should also be mentioned that the outer tube 6 and the gear wheel 12 are injection moulded together and both are made of plastic.

Alternatively, however, it is also possible that the outer tube 6 and the gear wheel 12 are made of metal.

Furthermore, the outer tube 6 with the gear wheel 12 can be produced by generative manufacturing processes ("rapid prototyping").

The outer tube 6 together with the integrally formed gear wheel 12 forms a replacement part that can be easily and inexpensively replaced, so that no cleaning is required.

The assembly and disassembly of the outer tube 6 with the integrally formed gear wheel 12 can be carried out without tools, for example by means of a bayonet lock not shown.

Figure 3A:
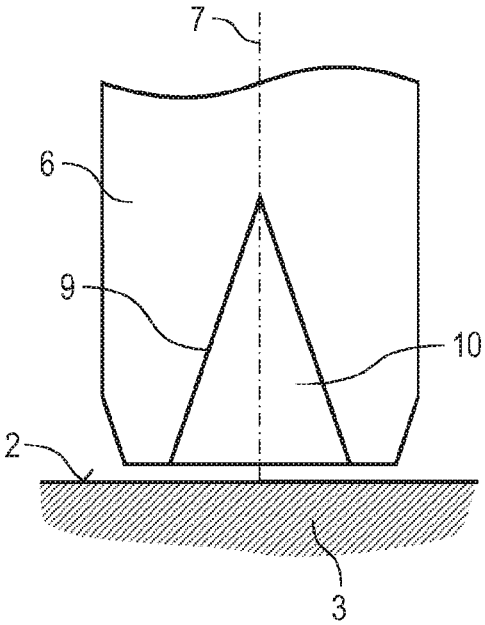
FIG. 3A is a side view of the applicator on a component surface for applying a thick matter bead.
Figure 3B:
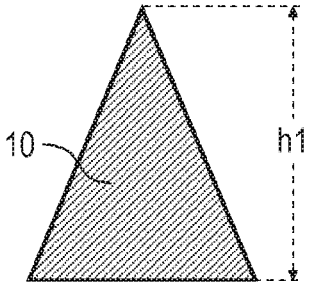
FIG. 3B shows the resulting size of the nozzle opening in the setting according to FIG. 3A.
Figure 4B:
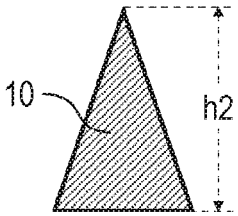
FIG. 4B shows the reduced size of the nozzle opening.

FIGS. 3B and 4B further show that by rotating the outer tube 6 relative to the inner tube, the height h1 or h2 of the nozzle opening 10 can be changed, whereby this change in the height h1, h2 of nozzle opening 10 leads to a corresponding change in the height of the thick matter bead applied.

On the one hand, this disclosure allows fine adjustment of the quantities of thick matter applied, especially for small quantities and small seam widths. In addition, the disclosure enables dynamic, variable adjustment, which is even possible during a coating path. In addition, the disclosure simplifies maintenance because the replacement part consisting of the outer tube 6 and the gear wheel 12 can be easily replaced without the need for cleaning. Another advantage is the simple nozzle change, as the outer tube 6 can be changed without tools with the integrally formed gear wheel 12.

The disclosure does not only claim protection for the embodiment described above. Rather, a large number of variants and modifications are possible which also make use of the inventive idea and therefore fall within the scope of protection. In particular, the disclosure also claims protection for the subject matter and the features of the dependent claims irrespective of the claims referred to in each case and in particular also without the features of the main claim or the dependent claims.

LIST OF REFERENCE SIGNS

1 Applicator
2 Component surface
3 Component
4 Inner tube
5 Frontal orifice of the inner tube
6 Outer tube
7 Longitudinal axis of outer tube and inner tube
8 V-shaped nozzle contour in the inner tube
9 V-shaped nozzle contour in the outer tube
10 Nozzle opening
11 Cutting edge
12 Gear wheel
13 Gear wheel
h1 Height of nozzle opening in axial direction
h2 Height of nozzle opening in axial direction

The invention claimed is:

1. An applicator for applying a coating agent to a component, having a nozzle with a nozzle opening having a nozzle geometry, wherein the nozzle geometry of the nozzle opening is adjustable without replacement of the nozzle;

wherein the nozzle has an inner tube, the coating agent to be applied flows through the inner tube during operation, the nozzle has an outer tube which surrounds the inner tube on the outside, the outer tube runs coaxially to the inner tube, the outer tube is rotatable relative to the inner tube about its longitudinal axis in order to adjust the nozzle geometry; and wherein an inner diameter of the outer tube is substantially equal to an outer diameter of the inner tube, and a wall of the outer tube is knife-shaped at a peripheral edge of a second nozzle contour and rests with a cutting edge on an outer wall of the inner tube.

2. The applicator according to claim 1, wherein the size of the nozzle opening is adjustable in order to influence the height of the thick matter bead on the component surface.

3. The applicator according to claim 2, wherein the shape of the nozzle opening is adjustable.

4. The applicator according to claim 1, wherein the height of the nozzle opening in the axial direction is adjustable.

5. The applicator according to claim 1, wherein a) the inner tube has a first nozzle contour in its circumferential surface, which forms the nozzle opening, b) the outer tube has a second nozzle contour in its circumferential surface, which forms the nozzle opening, and c) the first nozzle contour in the inner tube and the second nozzle contour in the outer tube lie more or less on top of one another as a function of the angular orientation of the outer tube relative to the inner tube and form the nozzle opening in the region lying on top of one another conforming to each other.

6. The applicator according to claim 5, wherein the first nozzle contour and the second nozzle contour are substantially V-shaped and each start from the peripheral edge of the inner tube or the outer tube at its free end and narrow in the proximal direction.

7. The applicator according to claim 1, wherein a) the applicator has a drive for adjusting the nozzle geometry of the nozzle opening, and b) the drive has a motor, and c) the drive is a gear drive, and d) a first gear wheel is arranged rotatably and coaxially to the outer tube and rotationally rigidly connected to the outer tube, and e) a rotatable second gear engages the first gear wheel to rotate the outer tube relative to the inner tube.

8. The applicator according to claim 7, wherein the first gear wheel is integrally formed on the outer tube.

9. The applicator according to claim 8, wherein the first gear wheel together with the outer tube forms an injection-moulded part.

10. The applicator according to claim 7, wherein the drive operates pneumatically.

11. The applicator according to claim 1, wherein the nozzle is designed such that, in operation, it applies a thick matter bead to a component surface of the component when the nozzle is moved over the component surface.

12. The applicator according to claim 1, wherein the applicator has a connecting flange for detachable mounting of the applicator, for example on an application robot, the connecting flange being operable without tools.

13. The applicator according to claim 1, wherein the outer tube can be removed from the inner tube without tools.

14. An applicator for applying a coating agent to a component, having a nozzle with a nozzle opening having a nozzle geometry, wherein the nozzle geometry of the nozzle opening is adjustable without replacement of the nozzle;

wherein the nozzle has an inner tube, the coating agent to be applied flows through the inner tube during operation, the nozzle has an outer tube which surrounds the inner tube on the outside, the outer tube runs coaxially to the inner tube, the outer tube is rotatable relative to the inner tube about its longitudinal axis in order to adjust the nozzle geometry; and wherein the applicator has a drive for adjusting the nozzle geometry of the nozzle opening, the drive has a motor, the drive is a gear drive, a first gear wheel is arranged rotatably and coaxially to the outer tube and rotationally rigidly connected to the outer tube, and a rotatable second gear engages the first gear wheel to rotate the outer tube relative to the inner tube.

15. The applicator according to claim 14, wherein the first gear wheel is integrally formed on the outer tube.

16. The applicator according to claim 15, wherein the first gear wheel together with the outer tube forms an injection-moulded part.

17. The applicator according to claim 14, wherein the drive operates pneumatically.

* * * * *